US011311771B2

(12) United States Patent
Corrao

(10) Patent No.: US 11,311,771 B2
(45) Date of Patent: Apr. 26, 2022

(54) TRAINING APPARATUS WITH SWIVEL STEP PLATE

(71) Applicant: Stephanie Marie Corrao, Island Park, NY (US)

(72) Inventor: Stephanie Marie Corrao, Island Park, NY (US)

( * ) Notice: Subject to any disclaimer, the term of this patent is extended or adjusted under 35 U.S.C. 154(b) by 15 days.

(21) Appl. No.: 16/830,865

(22) Filed: Mar. 26, 2020

(65) Prior Publication Data

US 2020/0324162 A1 Oct. 15, 2020

Related U.S. Application Data

(60) Provisional application No. 62/831,443, filed on Apr. 9, 2019.

(51) Int. Cl.

| | |
|---|---|
| ***A63B 22/20*** | (2006.01) |
| ***A63B 21/04*** | (2006.01) |
| ***A63B 21/00*** | (2006.01) |
| ***A63B 21/055*** | (2006.01) |
| ***A63B 71/06*** | (2006.01) |
| ***A63B 22/00*** | (2006.01) |

(52) U.S. Cl.

CPC ..... *A63B 22/205* (2013.01); *A63B 21/00069* (2013.01); *A63B 21/0428* (2013.01); *A63B 21/0557* (2013.01); *A63B 21/154* (2013.01); *A63B 21/4034* (2015.10); *A63B 21/4035* (2015.10); *A63B 71/0619* (2013.01); *A63B 2022/0074* (2013.01); *A63B 2071/0675* (2013.01); *A63B 2220/833* (2013.01); *A63B 2225/685* (2013.01); *A63B 2225/687* (2013.01)

(58) Field of Classification Search

CPC ..... A63B 22/20; A63B 22/00; A63B 22/203; A63B 22/201; A63B 22/205; A63B 2022/206; A63B 69/18; A63B 69/182; A63B 2244/19; A63B 21/00069; A63B 71/0619; A63B 2220/833; A63B 2022/0074; A63B 2225/685; A63B 2225/687; A63B 2071/0675; A63B 2220/17; A63B 2220/51; A63B 2230/06; A63B 2230/42; A63B 2071/0638; A63B 2225/093; A63B 2225/20; A63B 22/0664; A63B 22/0605; A63B 22/0056; A63B 22/16; A63B 22/14; A63B 2022/0038

See application file for complete search history.

(56) References Cited

U.S. PATENT DOCUMENTS 2,206,902 A * 7/1940 Kost ..... A61H 1/0266 601/27
3,707,283 A * 12/1972 Cormier ..... A63B 69/18 482/71

(Continued)

*Primary Examiner* — Garrett K Atkinson
(74) *Attorney, Agent, or Firm* — Dunlap Bennett & Ludwig, PLLC; Brendan E. Squire

(57) ABSTRACT

A training apparatus with swivel step plates and programmable music built in for a dance lesson and workout on the training apparatus. The step plate has a movement mechanism that reciprocates with a vertical component and a longitudinal component. The step plate is attached to the movement mechanism such that the step plate has a pivoting action about a vertical axis that is orthogonal to the orientation of a top surface of the step plate.

17 Claims, 3 Drawing Sheets

(56) References Cited

U.S. PATENT DOCUMENTS 4,629,181 A * 12/1986 Krive ..... A63B 69/18 482/146
4,739,986 A * 4/1988 Kucharik ..... A63B 23/08 482/146
4,744,557 A * 5/1988 Smirmaul ..... A63B 69/18 434/253
4,744,558 A * 5/1988 Smirmaul ..... A63B 69/18 434/253
4,953,853 A * 9/1990 Loane ..... A63B 69/18 482/130
4,961,570 A * 10/1990 Chang ..... A63B 22/0056 482/53
5,020,793 A * 6/1991 Loane ..... A63B 69/18 434/253
5,147,257 A * 9/1992 Loane ..... A63B 69/18 482/146
5,518,476 A * 5/1996 McLeon ..... A63B 23/08 482/79
5,897,464 A * 4/1999 Mcleod ..... A63B 23/08 482/79
6,569,064 B1 * 5/2003 Loane ..... A63B 21/154 482/146
6,708,754 B2 * 3/2004 Wei ..... F28D 15/0241 165/104.33
6,767,313 B2 * 7/2004 Sayce ..... A63B 69/18 482/146
7,090,621 B2 * 8/2006 Loane ..... A63B 21/0552 482/51
7,364,534 B2 * 4/2008 Zoller ..... A63B 23/08 482/79
7,803,091 B2 * 9/2010 Loane ..... A63B 69/18 482/70
8,636,627 B2 * 1/2014 Zhang ..... A63B 22/0664 482/52
9,186,543 B2 * 11/2015 Loane ..... A63B 21/00069
9,357,812 B2 * 6/2016 Elbaz ..... A43B 7/1445
9,788,597 B2 * 10/2017 Elbaz ..... A43B 7/1445
10,258,821 B2 * 4/2019 Jeong ..... A63B 21/4034
10,967,220 B2 * 4/2021 Gouzenko ..... G06F 3/011
10,967,237 B2 * 4/2021 Gouzenko ..... A63B 23/08
2006/0211544 A1 * 9/2006 Loane ..... A63B 21/4009 482/70
2006/0229159 A1 * 10/2006 Nagata ..... A63B 22/16 482/1
2009/0176631 A1 * 7/2009 Blessing ..... A63B 22/203 482/71
2010/0120590 A1 * 5/2010 Inaizumi ..... A63B 23/0405 482/99
2010/0145233 A1 * 6/2010 Zhang ..... A61B 5/1124 600/592
2012/0108406 A1 * 5/2012 Jeong ..... A63B 21/159 482/146
2015/0119204 A1 * 4/2015 Loane ..... A63B 21/00069 482/71
2017/0239517 A1 * 8/2017 Jeong ..... A63B 22/16

* cited by examiner

TRAINING APPARATUS WITH SWIVEL STEP PLATE

CROSS-REFERENCE TO RELATED APPLICATION

This application claims the benefit of priority of U.S. provisional application No. 62/831,443, filed Apr. 9, 2019, the contents of which are herein incorporated by reference.

BACKGROUND OF THE INVENTION

The present invention relates to physical training apparatus, and more particularly to stepping or elliptical physical training apparatus.

Stepping exercise apparatus, such as the Stairmaster®, have been around for ages and have been one the most effective workout for legs, thighs and butt. A close counterpart of the stepper is the elliptical training machines. Each of these apparatus have a foot plate 32 upon which the user places their foot to operate the device during an exercise regimen.

One issue with such apparatus is that the contact between the user's feet is a frictional interface. Generally speaking, while the user's foot and ankle may be flexed during the exercise, the feet are otherwise maintained in an alignment with the footplate due to the frictional contact of the user's shoe with the footplate. Unless the user repositions their feet on the footplate, they may not completely exercise the various muscle groups in the leg due to the relatively fixed positioning of the feet and thereby the balance provided while exercising.

Another problem with such exercise apparatus is that the user may become bored while exercising, due to the relative stability of the footplate and the repetitive motion of the apparatus. Due to the inherent stability of the footplate, once the user has stabilized at a particular pace, the body may become more relaxed into a comfort zone due to the stability of their steps and strides due to the fixed path of the exercise apparatus.

As can be seen, there is a need for an improved interface for a stepping or elliptical exercise apparatus that provides a more complete workout of the muscle groups and reduces boredom while exercising.

SUMMARY OF THE INVENTION

In one aspect of the present invention, a swiveling step plate for an exercise apparatus is disclosed. The swiveling step plate includes a shaft having a proximal end and a distal end. The distal end is configured to attach to a reciprocating mechanism of the exercise apparatus. An elongate plate is dimensioned to support a foot of a user. The elongate plate is attached to the proximal end of the shaft via a pivot assembly. The pivot assembly supports the elongate plate for pivotal rotation about a vertical axis extending through the elongate plate.

In some embodiments, the swiveling step plate includes a transverse pivot coupling the distal end of the shaft to the reciprocating mechanism of the exercise apparatus, the transverse pivot supports the elongate plate for pivoting about a transverse axis extending through the elongate plate.

In other embodiments, a transverse pivot couples the proximal end of the shaft to the elongate plate. The transverse pivot supports the elongate plate for pivoting about a transverse horizontal axis extending through the elongate plate.

In some embodiments, a collar is attached to the distal end of the shaft. The collar is dimensioned to be carried in a vertically inclined track supported by the exercise apparatus.

In other embodiments, a resistance attachment point is configured to couple the shaft to a resistance adjuster.

In other aspects of the invention, an exercise apparatus is disclosed. The exercise apparatus includes an upstanding frame member supporting a reciprocating mechanism. A shaft has a proximal end and a distal end. The distal end of the shaft is attached to the reciprocating mechanism. An elongate plate is dimensioned to support a foot of a user. The elongate plate is attached to the proximal end of the shaft via a pivot assembly. The pivot assembly supports the elongate plate for pivotal rotation about a vertical axis extending through the elongate plate.

In some embodiments, the exercise apparatus includes a transverse pivot coupling the distal end of the shaft to the reciprocating mechanism. The transverse pivot supports the elongate plate for pivoting about a transverse horizontal axis extending through the elongate plate.

In other embodiments, a transverse pivot couples the proximal end of the shaft to the elongate plate. The, the transverse pivot supports the elongate plate for pivoting about a transverse horizontal axis extending through the elongate plate.

In some embodiments, the reciprocating mechanism includes a vertically inclined track. A collar is attached to the distal end of the shaft. The collar is dimensioned to be carried in the vertically inclined track.

In yet other embodiments, a resistance mechanism is coupled to vary a resistance of the reciprocating mechanism. The resistance mechanism may include a resistance band carried by a resistance pulley at a first end and a second end of the vertically inclined track. A resistance attachment point at the distal end of the shaft is coupled to the resistance band.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improvement over the conventional stepping or elliptical training apparatus that fosters improved balance and the ability to work additional muscle groups during an exercise regimen. The exercise apparatus is configured with a stepping mechanism that allows the user to move the step plate in path with a vertical component and a longitudinal component. The step plate also includes a mount that such that the step plate is pivotal about a vertical axis.

Figure 1:
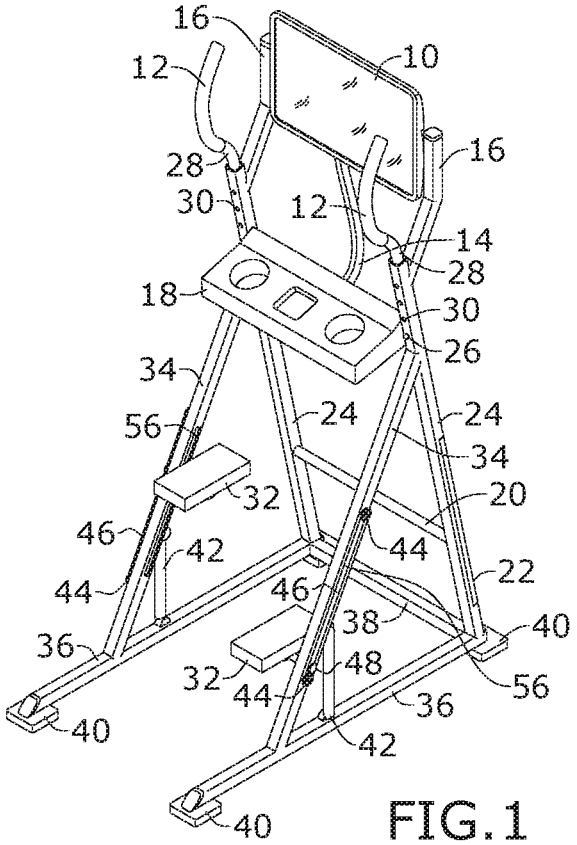
FIG. 1 is a perspective view a training apparatus with a swivel step plate.
Figure 2:
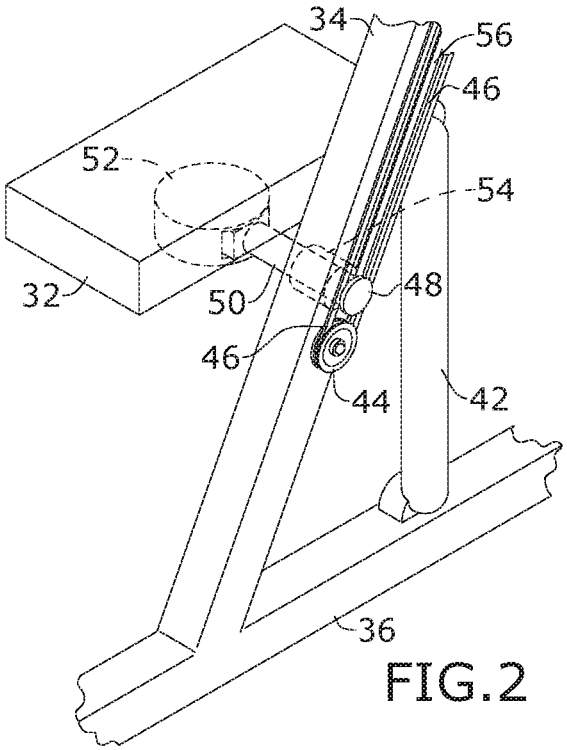
FIG. 2 is a detailed perspective a swivel step plate attachment to the training apparatus.
Figure 4:
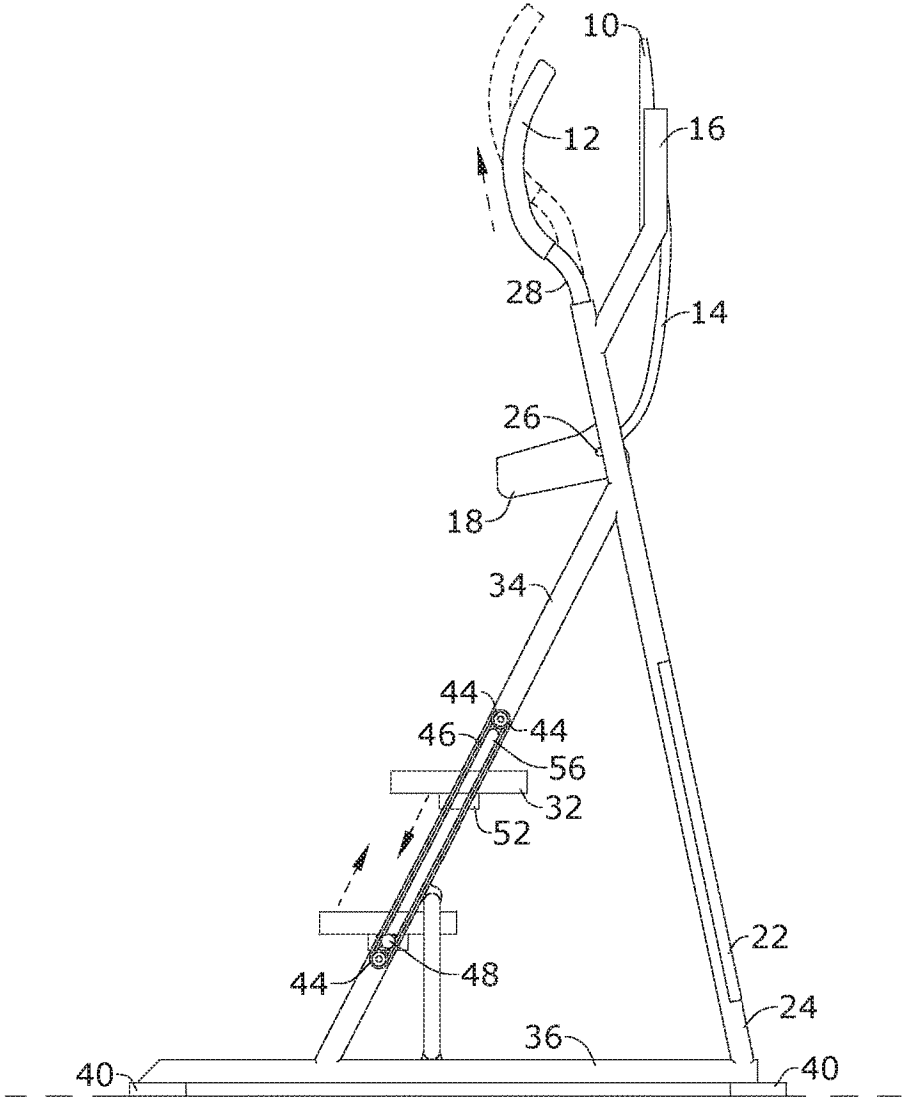
FIG. 4 is a side elevation view of the training apparatus with a swivel step plate.
Figure 3:
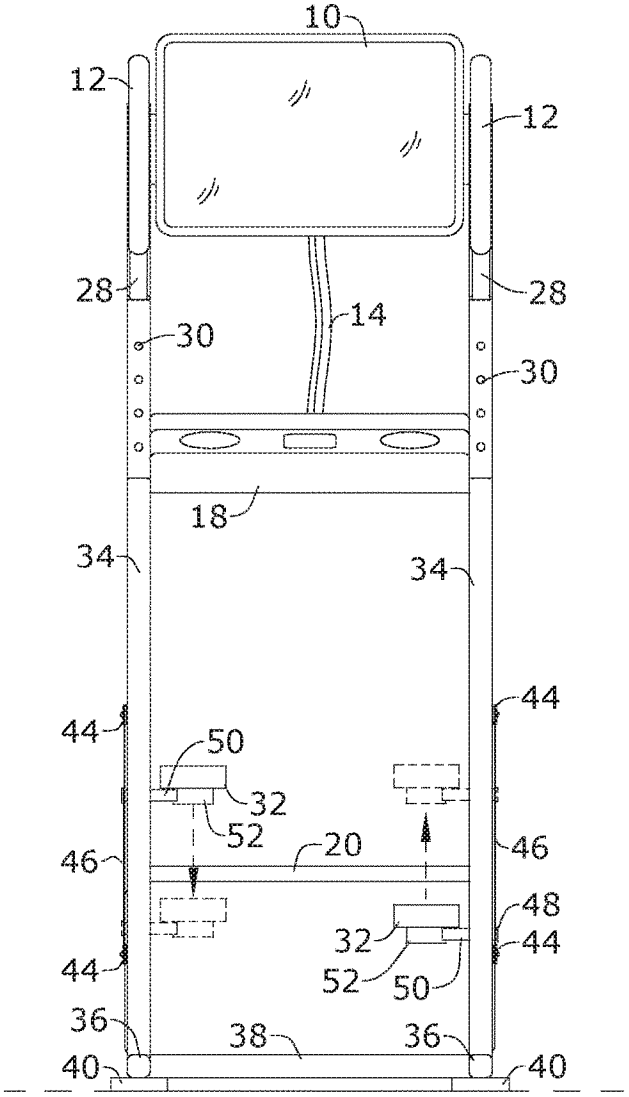
FIG. 3 is a front elevation view of the training apparatus with a swivel step plate.
Figure 5:
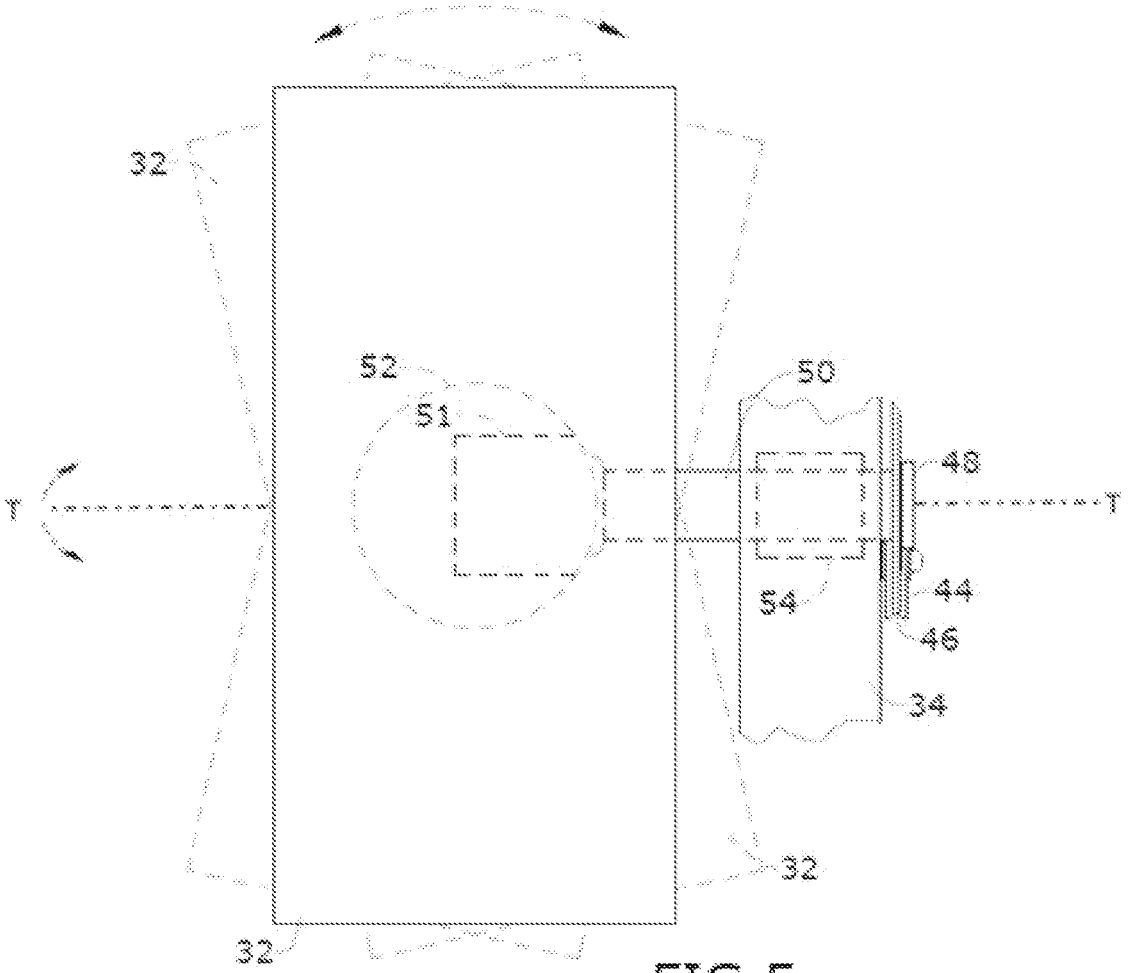
FIG. 5 is a detailed top plan view of the right swivel step plate.

As seen in reference to the drawings of FIGS. 1-5, an exercise apparatus with swiveling step plate may include the following components. A touch display panel 10 is provided for display of a plurality of controls for setting exercise parameters for the exercise apparatus, including a resistance, a duration, a workout routine, and the like. The touch display 10 is supported by a display support arms 16.

The display panel 10 may also provide performance metrics of the user while using the exercise apparatus. The performance metrics may be provided by one or more sensors coupled to one of the exercise apparatus or the user to indicate the performance of the user. Exercise apparatus sensors may include a step rate, a resistance, and the like. Biometric sensors coupled to the user may include a heart rate sensor, a respiratory rate sensor, and the like.

The display panel 10 may also provide audiovisual outputs, including a virtual workout routine environment in which the user participates through the exercise apparatus. The workout routine environment may include a depiction of exercise routine maneuvers that the user emulates or performs during the workout routine. In preferred embodiments, the exercise routine maneuvers may include a dance routine and an accompanying audio track for the dance routine.

The exercise apparatus may include a pair of adjustable handgrips 12 at the ends of handlebar arms 28 adjustably carried by a forward support frame member 24. The handlebar arms 28 may be adjusted by a plurality of spaced apart apertures 30 and an adjustment pin 26.

An electronics coupling 14 may provide for a plurality of electronics communications between a mobile computing device, such as LCD I HDMI I serial I power ports with the display panel 10. The electronics coupling 14, may be provided in proximity to an accessory tray 18 for supporting the mobile computing device and other user items, such as a cup holder, and a tray for holding items such as keys, identification, and the like. The forward support frame 24 may include a channel 22 for carrying communications, such as cable TV and Internet connections as well as a power cable for powering the display 10 and other electronics carried by the exercise apparatus.

The swiveling step plates 32 are coupled to a reciprocating mechanism of the exercise apparatus via a shaft 50. In the non-limiting embodiment shown, the reciprocating mechanism may include an elongate track 56 defined along an angled support member 34. In other embodiments, the reciprocating mechanism may include a stepping mechanism, a pedaling mechanism, or an elliptical mechanism.

In the embodiment shown, a top end of the angled support member 34 attaches to the forward frame 24, while a bottom end of the angled support member 34 attaches to a base frame 36. One or more base cross frame elements 38 may also be provided. The frame elements may be carried on a plurality of feet 40, which may be a rubberized material to protect a floor surface form damage. A stress damper 42 may be provided to interconnect the base frame 36 with an intermediate portion of the angled support member 34 to relieve a bowing of the angled support member 34 during use of the exercise apparatus.

A resistance adjuster in the reciprocating mechanism allows the user to adjustably configure a workout resistance of the reciprocating mechanism. In the non-limiting embodiment shown, the resistance adjuster may include a tension band 46 that is operatively connected to a tension connection 48 at a distal end of a shaft 50 supporting the swiveling step plates 32. The tension band 46 may be carried by a plurality of tension band pulleys 44 that adjustably carry the tension band 46.

The shaft 50 has a proximal end and a distal end. The distal end is operatively connected to the reciprocating mechanism and the proximal end is connected to the swiveling step plate 32. The swiveling step plate 32 is coupled to the reciprocating mechanism via a transverse pivot for axial pivoting rotation about a transverse horizontal axis T of the step plate 32 at one of the distal end or the proximal end of the shaft 50. For example, the transverse pivot may include a collar 54 that may be provided to pivotally carry the distal end within the elongate track 56. Alternatively, the proximal end of the shaft 50 may also include a transverse pivot 51. Stops may be included in the transverse pivot to limit the axial rotation of the swiveling step plate 32 about the transverse axis T.

The swiveling step plate 32 according to aspects of the invention also includes a pivot assembly 52 that permits pivotal movement of the step plate 32 about a vertical axis extending through the swiveling step plate 32. The pivot assembly 52 may also include a stop to limit the axial rotation of the swiveling step plate 32 about the vertical axis of the step plate.

In use, the user would place their feet on each of a left and a right step plate 32. The user would then operate their legs in a reciprocating fashion on the exercise apparatus, as in conventional stepping or reciprocating exercise apparatus. However, since most people exercising with a training apparatus become bored because due to the constrained nature of the reciprocating mechanism it the exercise apparatus gets boring, leading many users to stop exercising. With the improvements of the present invention, the user can pivot their feet on the step plate 32 while exercising, which increases their alertness during their exercise regimen and facilitates their exercising additional muscle groups of the legs and buttocks.

The pivotal arrangement of the step plate 32 about a vertical axis can also enables the user to perform a modified dance routine in while performing their stepping exercise regimen. This can alleviate the boredom of the conventional stepping apparatus. Moreover, with the integrated programmable music selection and video display 10, the user may select a dance routine to follow on the video display 10, or they may choose some other scenery in the display 10 and a desired dance music in the audio for developing their own dance routine while they work out.

The machine may also be configured to provide access to a monthly subscription service that allows users to follow live classes. Users will be able to watch live or on demand classes and routines. This machine will allow you to learn how dance different dances and work out on the stair master at the same time, with no more boring workouts.

It should be understood, of course, that the foregoing relates to exemplary embodiments of the invention and that modifications may be made without departing from the spirit and scope of the invention as set forth in the following claims.

What is claimed is:

1. A swiveling step plate for an exercise apparatus, comprising:

a shaft having a proximal end and a distal end, the distal end configured to attach to a reciprocating mechanism of the exercise apparatus for traversal along a path of the reciprocating mechanism;

an elongate plate dimensioned to support a foot of a user, the elongate plate attached to the proximal end of the shaft via a pivot assembly; and the pivot assembly supporting the elongate plate for pivotal rotation about a vertical axis extending through the elongate plate.

2. The swiveling step plate of claim 1, further comprising:

a transverse pivot coupling the distal end of the shaft to the reciprocating mechanism of the exercise apparatus, the transverse pivot supporting the elongate plate for pivoting about a transverse axis extending through the shaft.

3. The swiveling step plate of claim 1, further comprising:

a transverse pivot coupling the proximal end of the shaft to the elongate plate, the transverse pivot supporting the elongate plate for pivoting about a transverse horizontal axis extending through the shaft.

4. The swiveling step plate of claim 1, further comprising:

a collar attached to the distal end of the shaft, the collar dimensioned to be carried in a vertically inclined track supported by the exercise apparatus.

5. The swiveling step plate of claim 4, further comprising:

a resistance attachment point configured to couple the shaft to a resistance adjuster.

6. An exercise apparatus, comprising:

an upstanding frame member supporting a reciprocating mechanism;

a shaft having a proximal end and a distal end, the distal end attached to the reciprocating mechanism for traversal along a path of the reciprocating mechanism;

an elongate plate dimensioned to support a foot of a user, the elongate plate attached to the proximal end of the shaft via a pivot assembly; and the pivot assembly supporting the elongate plate for pivotal rotation about a vertical axis extending through the elongate plate.

7. The exercise apparatus of claim 6, further comprising:

a transverse pivot coupling the distal end of the shaft to the reciprocating mechanism, the transverse pivot supporting the elongate plate for pivoting about a transverse horizontal axis extending through the shaft.

8. The exercise apparatus of claim 6, further comprising:

a transverse pivot coupling the proximal end of the shaft to the elongate plate, the transverse pivot supporting the elongate plate for pivoting about a transverse horizontal axis extending through the shaft.

9. The exercise apparatus of claim 6, wherein the path of the reciprocating mechanism includes a vertically inclined track.

10. The exercise apparatus of claim 9, further comprising:

a collar attached to the distal end of the shaft, the collar dimensioned to be carried in the vertically inclined track.

11. The exercise apparatus of claim 10, further comprising:

a resistance mechanism coupled to vary a resistance of the reciprocating mechanism.

12. The exercise apparatus of claim 11, wherein the resistance mechanism comprises:

a resistance pulley at each of a first end and a second end of the vertically inclined track;

a resistance band carried by each resistance pulley; and a resistance attachment point at the distal end of the shaft coupled to the resistance band.

13. A swiveling step plate for an exercise apparatus, comprising:

a shaft having a proximal end and a distal end;

an elongate plate dimensioned to support a foot of a user, the elongate plate attached to the proximal end of the shaft via a pivot assembly;

the pivot assembly supporting the elongate plate for pivotal rotation about a vertical axis extending through the elongate plate; and the distal end configured to couple with a reciprocating mechanism of the exercise apparatus so that the swiveling step plate is carried by the reciprocating mechanism.

14. The swiveling step plate of claim 13, further comprising:

a transverse pivot coupling the distal end of the shaft to the reciprocating mechanism of the exercise apparatus, the transverse pivot supporting the elongate plate for pivoting about a transverse axis extending through the shaft.

15. The swiveling step plate of claim 13, further comprising:

a transverse pivot coupling the proximal end of the shaft to the elongate plate, the transverse pivot supporting the elongate plate for pivoting about a transverse horizontal axis extending through the shaft.

16. The swiveling step plate of claim 13, further comprising:

a collar attached to the distal end of the shaft, the collar dimensioned to be carried in a vertically inclined track supported by the exercise apparatus.

17. The swiveling step plate of claim 13, further comprising:

a resistance attachment point configured to couple the shaft to a resistance adjuster of the exercise apparatus.

* * * * *